US006131640A

United States Patent [19]

Judkins

[11] Patent Number: 6,131,640

[45] Date of Patent: Oct. 17, 2000

[54] LENGTH ADJUSTABLE BOTTOMRAIL FOR VENETIAN TYPE BLIND

[76] Inventor: Ren Judkins, 46 Newgate Rd., Pittsburgh, Pa. 15202

[21] Appl. No.: 09/215,494

[22] Filed: Dec. 18, 1998

[51] Int. Cl.[7] ..... E06B 9/30

[52] U.S. Cl. ..... 160/168.1 R; 160/173 R; 24/130

[58] Field of Search ..... 24/130; 160/178.1 R, 160/167 R, 168.1 R, 176.1 R, 178.3 R, 169 R

[56] References Cited

U.S. PATENT DOCUMENTS

| | | | |
|---|---|---|---|
| 1,898,940 | 2/1933 | Cooper | 160/178.1 R |
| 2,100,648 | 11/1937 | Lawson et al. | 160/178.1 R |
| 2,560,858 | 7/1951 | Grogan | 160/178.1 R |
| 2,624,086 | 1/1953 | Schaefer | 160/178.1 R |
| 2,627,917 | 2/1953 | Lind | 160/173 |
| 2,652,112 | 9/1953 | Walker | 160/173 |
| 2,659,430 | 11/1953 | Lorentzen | 160/173 |
| 2,756,816 | 7/1956 | Radel et al. | 160/173 |
| 2,784,780 | 3/1957 | Evans | 160/178.3 R |
| 2,786,521 | 3/1957 | Evans | 160/178.3 R |
| 2,796,927 | 6/1957 | Evans | 160/178.3 R |
| 2,952,206 | 9/1960 | Beckstead . | |
| 3,636,594 | 1/1972 | Faivre . | |
| 4,177,853 | 12/1979 | Anderson et al. | 160/168 R |
| 4,487,243 | 12/1984 | Debs | 160/178.1 R |
| 5,573,051 | 11/1996 | Judkins | 160/168.2 |
| 5,791,022 | 8/1998 | Bohman . | |
| 5,918,656 | 7/1999 | Daniels | 160/168.1 R |
| 5,926,924 | 7/1999 | Tsai . | |
| 5,947,176 | 9/1999 | Judkins | 160/168.1 R |

FOREIGN PATENT DOCUMENTS

| | | |
|---|---|---|
| 1 252 878 | 10/1967 | Germany . |
| 1 509 182 | 12/1968 | Germany . |

*Primary Examiner*—Blair M. Johnson
*Attorney, Agent, or Firm*—Buchanan Ingersoll, P.C.

[57] ABSTRACT

A venetian type blind has a length adjustable bottomrail to fit windows of different lengths. A cord stop device is attached to each lift cord and each cord stop device is shaped such that when the device is attached to a lift cord the cord stop device can be removably connected to a retainer in the bottomrail and when not connected to the retainer will orient itself to be self-guiding through route holes in selected slats when the lift cord is pulled through the selected slats. The blind is shortened by releasing each cord stop device from its retainer and passing the device and attached lift cord from the bottomrail through the slats to be removed to the slat at the desired length. The excess slats are removed. Then the ladders are detached from the bottomrail, shortened and reattached to the bottomrail. The cord stop devices are then reconnected to their respective retainers in the bottomrail to complete the shortening process.

4 Claims, 4 Drawing Sheets

LENGTH ADJUSTABLE BOTTOMRAIL FOR VENETIAN TYPE BLIND

FIELD OF INVENTION

The invention relates generally to a venetian type blind, and more particularly to a venetian type blind having a length adjustable bottomrail for customizing the length of the blind to fit windows of different lengths.

BACKGROUND OF THE INVENTION

Venetian type blinds have a series of slats hung on ladder cords which extend from a headrail to a bottomrail. Depending upon the width of the blind, two or more lift cords are provided. Usually, each lift cord is attached at one end to the bottomrail. The lift cords pass through elongated holes in the slats up to and through the headrail. A cord lock is usually provided in the headrail through which the lift cords pass. The cord lock allows the user to maintain the blind in any desired position from fully raised to fully lowered. The slats rest on rungs between the rails of the ladder cords. The blind is in an open position when the rungs are horizontal. To close most venetian blinds one lifts one rail while allowing the other rail to either remain in place or be lowered. Both the lift cords and the ladder cords are typically non-adjustably connected to the bottomrail.

In U.S. Pat. No. 5,573,051, there is shown a venetian type blind having slats that are notched to form slots on their inside edge and outside edge to accommodate the lift cords. The lift cords pass from the bottomrail to the headrail each passing through a slot on the inside edge or outside edge of each slat. At least two cord-type ladders are provided to hold the slats and are aligned such that the rails of the ladders are adjacent the lift cords and outside the slots cut in the slats. The slots are sized so that the lift cords and the ends of the rungs can loosely fit therein. Because lift cords travel within the slots provided in the slats no cord holes are needed in the slats.

It is known to customize venetian type blinds to fit windows of different sizes. Generally, a standard width blind which is closest to, but wider than, the window is selected to be modified. The headrail, bottomrail and slats are trimmed to fit the width of the window. To maintain symmetry, an equal amount is usually trimmed from each end of the slats. Since the length of the blind is adjustable by simply operating the lift cords, the length of the blind sometimes is not modified. Instead, a standard size blind which is nearest to, but longer than, the length of the window is chosen and the extra length is stacked on the bottomrail which rests on the window sill. However, this arrangement can be aesthetically unappealing and compromises the blind's closure when tilted. Equally unappealing is to simply remove the slats because the portion of the ladders which supported the removed slats would still remain. For the best appearance the blind should be nearly the same length as the window when fully extended. Any change in length must shorten the ladders as well as remove slats.

In venetian type blinds the rails of ladders, which typically are cords but could be tape, and the lift cords can be attached to the bottomrail in different ways. One manner of attaching a ladder tape to a bottomrail is shown in U.S. Pat. No. 2,652,112 to Walker wherein the lift cord passes through small openings in the middle of each slat. The bottomrail has a hole completely through the top and the bottom surfaces. The opening in the top surface of the bottomrail is slightly narrower than the opening in the bottom surface. The lift cord is inserted through the narrower opening and a knot is formed in the end so that it cannot be pulled back through the narrower opening. The rails of the tape ladder encompass the bottomrail. A channel is provided longitudinally along one side of the bottomrail into which a portion of the tape rail can be folded. A pin is then inserted into the longitudinal channel over the tape rail to frictionally hold the tape rail to the longitudinal channel.

Anderson et al. in U.S. Pat. No. 4,177,853 show a manner of connecting the lift cord and a ladder cord to the bottomrail. In Anderson, the bottomrail has a longitudinal channel provided along the upper surface and a hole provided in the lower surface for each lift cord. A plug is provided in each hole. Each lift cord passes through small openings in the center of each slat, through the longitudinal channel and is connected to a plug. The cord rails pass outside of and adjacent to each side of the bottomrail and are then inserted up through the hole in the lower surface. The cord rails are frictionally held in the opening by the plug. Similarly, to Anderson, German Patent Nos. 1 252 878 and 1 509 182 each disclose a manner of attaching a lift cord and ladder cords to a bottomrail wherein a longitudinal channel is provided in the upper surface of the bottomrail and a hole is provided in the lower surface. In each case the lift cord passes through small openings in the middle of each slat, through the longitudinal channel and attaches to the plug. The cord rails pass outside of and adjacent to each side of the bottomrail and are then inserted up through the hole in the lower surface. The plug frictionally retains the cord rails in the hole. In each case the plug is frictionally retained in the hole and/or is held therein because of the attachment to the lift cord.

Theoretically, the bottomrails described in Anderson and the two German patents could be adjusted for the length of the blinds by removing excess slats, removing the plug, cutting off the excess slack in the cord rails, reinserting the ends of the cord rails up through the hole in the underside of the bottomrail, and then reinserting the plug to hold the cord rails in place. However, one problem with such a procedure is that repeated removal and insertion of the plug results in the fit between the hole and the plug becoming looser such that the cord rails may not be securely held in the hole. Another is that it takes a significant amount of time for the novice.

Accordingly, there is a need for venetian blind having a bottomrail that is readily adjustable so that the blind can be easily customized to fit windows of different lengths. Such a blind should overcome the disadvantages in the prior art by eliminating the stack of excess slats on the bottomrail and the excess ladder portions. Such a blind should permit repeated disconnection and reconnection of the lift cords and ladders without loosening or otherwise deteriorating the connections.

SUMMARY OF THE INVENTION

I provide a venetian type blind having an adjustable bottomrail, headrail and plurality of slats hung on a cord-type ladders which extend between the headrail and bottomrail. The bottomrail is easily and quickly adjusted in length so that the blind can be customized to fit windows of different lengths. At least two lift cords pass from the bottomrail through holes in the slats to the headrail. The ladders are aligned such that each lift cord is adjacent one ladder. A stop device is attached to each lift cord and is releasably connected to a retainer in the bottomrail. This device is shaped to orient itself to be self-guiding through the holes in the slats when the lift cord is pulled and the device is not retained in the bottomrail. The bottomrail is length adjustable by detaching the ladders from the bottomrail, releasing the stop device from the bottomrail and passing that device through those slats to be removed. Then the extra slats are removed, the ladders are shortened and lift cords and ladders are attached to the bottomrail. The ladders can be attached to the bottomrail and shortened in any desired manner. If desired the extra portion of the ladders that contain excess slats can be cut away while the slats are on those portions. Yet another option is to remove the slats from the ladders and store the excess ladder portions in the bottomrail.

The stop device may be a snivee with a pointed end and a slot extending from the pointed end to allow the snivee to be retained on the lift cord in either of two positions, aligned with the cord or transverse to the cord. Another stop device is a frusto-conical body attached to the lift cord which has a removable plug. When the plug is removed the body can contact to a smaller diameter so as to pass through holes in the slats. Yet another stop device is an egg shaped body that is implanted in the lift cord.

Other objects and advantages of the present invention will become apparent from a description of the present preferred embodiments shown in the drawings.

DESCRIPTION OF THE PREFERRED EMBODIMENTS

Figure 1:
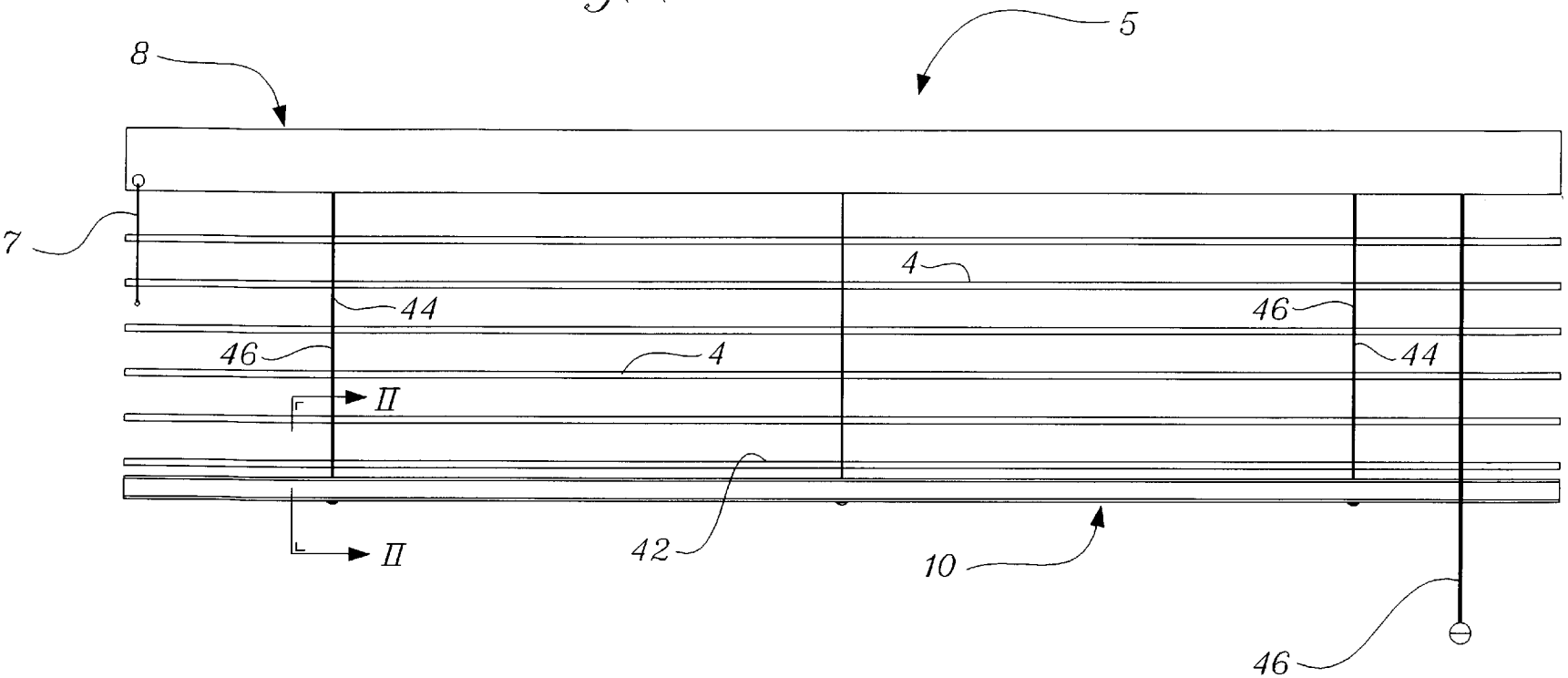
FIG. 1 is a front view of the present preferred embodiment of my venetian type blind shown in a lowered open position.
Figure 2:
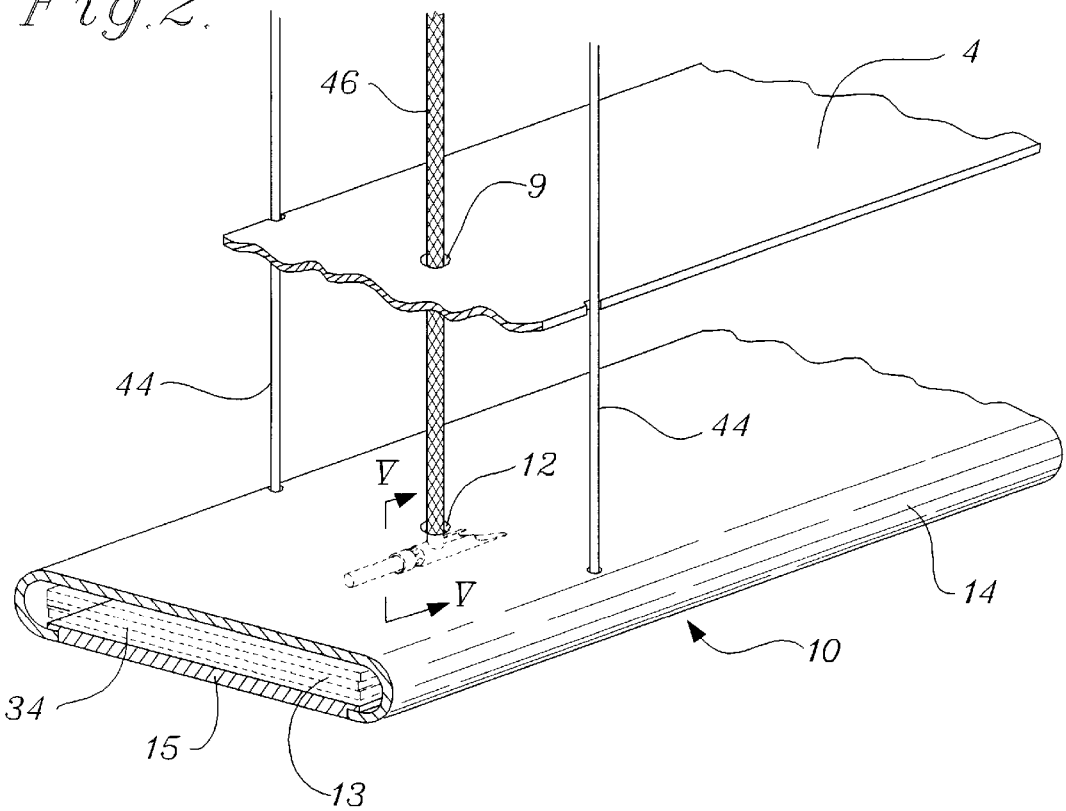
FIG. 2 is a perspective view taken along line II—II in FIG. 1.

The first presently preferred embodiment of my venetian type blind 5 shown in FIG. 1 has a headrail 8, a length adjustable bottomrail 10 and a set of slats 4 extending therebetween. For purposes of illustration only six slats 4 are shown. However, the blind 5 could have any number of slats and would likely have many more slats than are shown. As shown in FIG. 2, the slats 4 are suspended on a cord-type ladder 6 having cord rails 44 and rungs 48 (shown only in FIG. 6*d*) extending between the cord rails 44 on which the slats 4 rest. A tilt cord 7 is attached to a tilter (not shown) within the headrail that tilts the ladders 6 from the open position shown in FIG. 1 to a closed position. Lift cords 46 are attached to the bottomrail 10 and run through holes in the slats and into the headrail 8 to raise or lower the blind 5. In most common venetian blinds each lift cord passes through a route hole in each slat. The route holes 9 can be in the center of the slats as shown in FIG. 2 or close to one edge. The rails of the ladders can be attached to the bottomrail in any manner. Preferably this attachment permits easy release of the ladders so that the ladders can be readily shortened.

Referring to FIG. 2, a first present preferred bottomrail 10 has a hole 12 in the top 16 for each lift cord 46. One lift cord passes through each hole into a cavity 13 within the bottomrail. I prefer that the bottomrail have an elongated U-shaped body 14 and removable plastic bottom 15. The cavity may be constructed to be large enough to hold excess slats 34 shown in dotted line in FIG. 2. The ladders are attached to the bottomrail in any conventional way such as by tying a knot at the end of each ladder rail such that the knot is within the bottomrail. The attachment should permit the ladder to be readily detached, shortened and reattached to the bottomrail.

Figure 3:
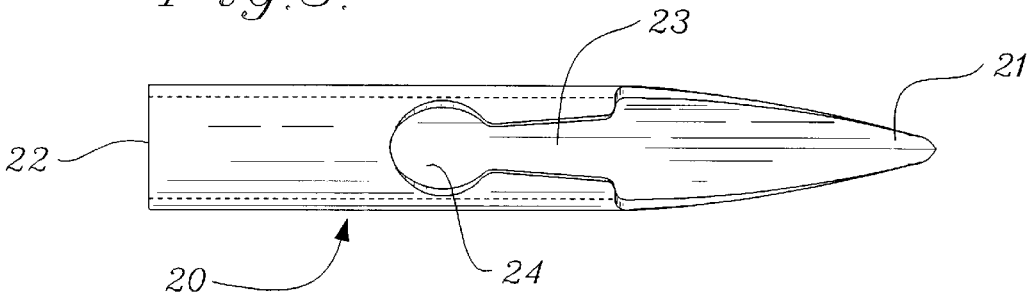
FIG. 3 is a top plan view of a first present preferred cord stop device in the form of a snivee.
Figure 4:
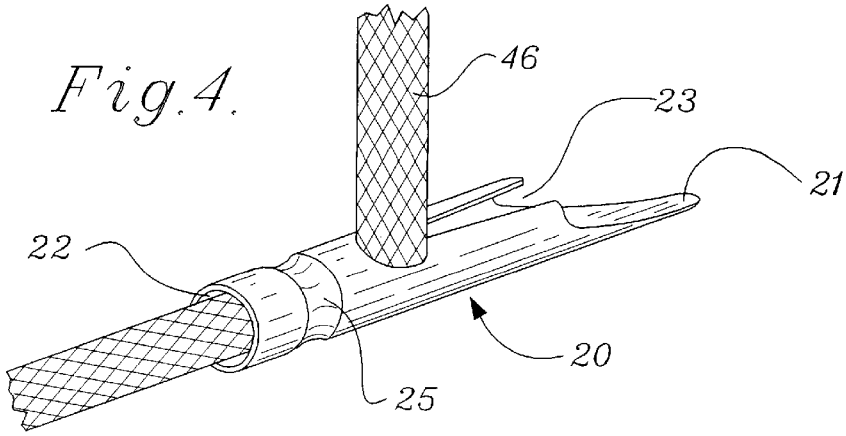
FIG. 4 is a perspective view of the snivee attached to a lift cord.
Figure 5:
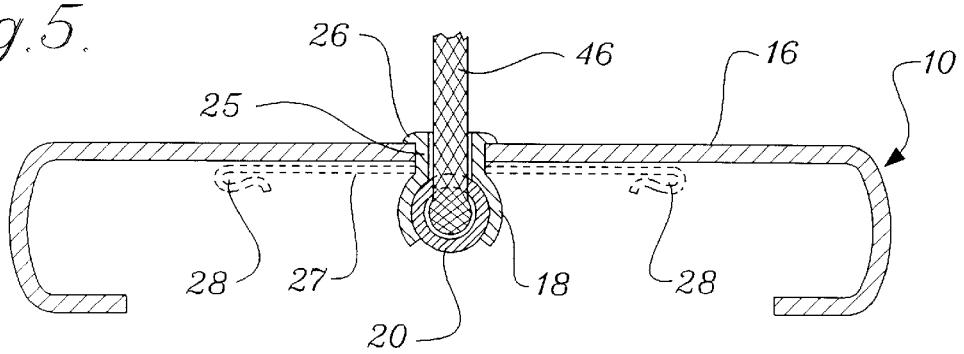
FIG. 5 is a cross sectional view taken along the line V—V in FIG. 2.
Figure 6A:
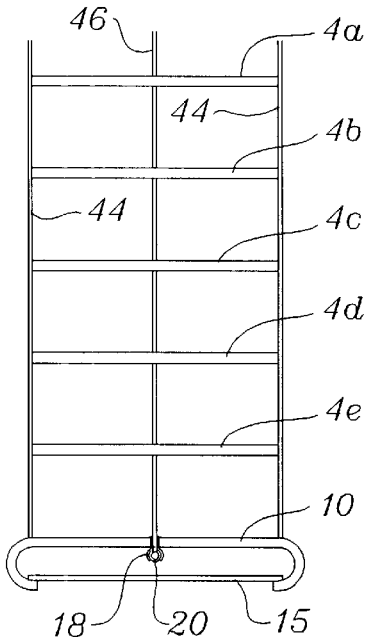
FIGS. 6*a* through 6*e* are end views of a lower portion of the blind illustrating my preferred method of shortening the blind.
Figure 6B:
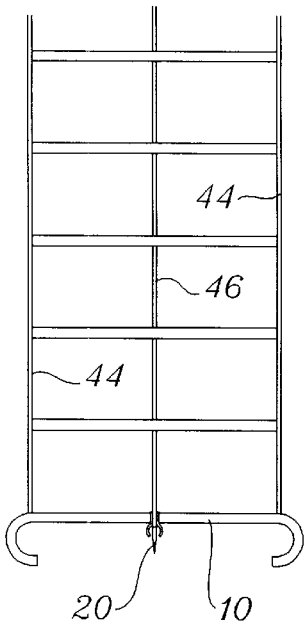
Figure 6C:
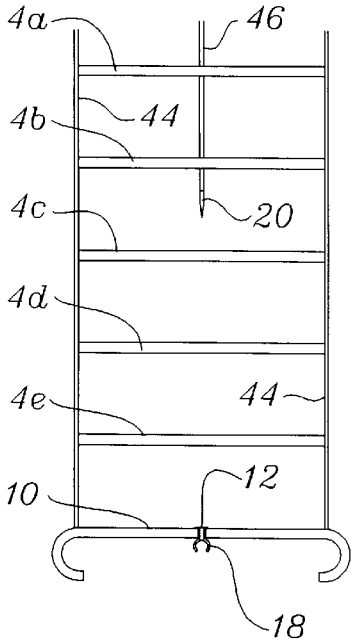
Figure 6D:
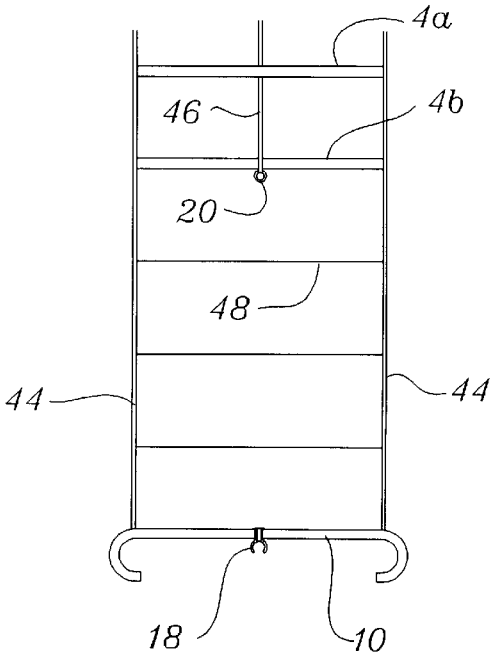

The lift cords 46 are inserted through the holes 12 and each lift cord is attached to a cord stop device such as a snivee 20. The snivee 20, as shown best in FIGS. 3 and 4, is tubular and has a pointed end 21 and a flat end 22. A tapered slot 23 extends from the pointed end 21 to a circular hole 24 through the sidewall of the snivee. The lift cord 46 is threaded through the snivee 20 from the pointed end through the flat end 22. A portion 25 of the snivee 20 is crimped to secure the snivee onto the lift cord 46. The lift cord 46 can then be in a first position lying along the longitudinal axis of the snivee as shown in FIGS. 6*b* and 6*c* or be in a second position shown in FIG. 4. As can be seen most clearly in FIG. 3 slot 23 has a wide opening at pointed end 21 and becomes narrower until the slot reaches hole 24. This slot permits the snivee 20 to be moved relative to the lift cord 46 from the first position to the second position and back to the first position. It is important that the cord stay in either of the selected positions and not change positions during use. The narrow opening at the pointed end restricts the lift cord from entering the slot until a force is applied by the installer. Each snivee has a length and a diameter transverse to the length such that the diameter of the snivee is smaller than the hole 12 in the top 16 of the bottomrail 10. The length of the snivee is greater than the diameter of the hole 12. Consequently, the snivee 20 can pass through the hole 12 when the length is perpendicular to the top 16 of the bottomrail 10 and be retained in the cavity 13 in the bottomrail when the length is parallel to the top of the bottomrail. As shown most clearly in FIG. 5 I optionally provide a retainer 18 attached to the underside of the top 16 of the bottomrail 10. The retainer 18 is flexible and sized to grip the snivee 20. The retainer shown in FIG. 5 has a cylindrical neck 25 which stays within hole 12 and a lip 26 which prevents the neck from coming out of the hole. Since the retainer is made of a flexible or compressible plastic the retainer can be snap fit into the hole 12. The retainer 18 may have two radially extending arms 27 which are shown in dotted line in FIG. 5. Each arm has a slot 28 in the distal end which is sized to receive and grip one of the rails of the ladder. Consequently, the ladder can be easily detached from the bottomrail, shortened and reattached. Alternatively one could provide a solid bottomrail and cut a cavity sized to retain one or two snivees. Such a cavity could be created by drilling a hole into the bottomrail that is transverse to and intersects the hole 12 through which the lift cord passes.

Figure 6E:
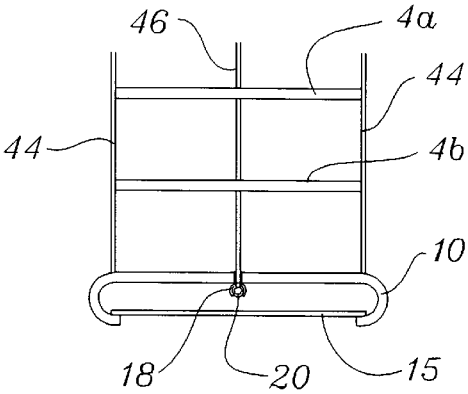

Referring now to FIGS. 6*a* through 6*e* I also provide a method for customizing the length of the a venetian type blind 5 having a length adjustable bottomrail 10 as described previously. According to my presently preferred method, the length of the window in which the blind is to be installed is measured and a standard length blind is initially selected. To create the best appearance, the fully extended length of the selected blind will be very close to the length of the window. Thus, a standard size blind having a length close to but longer than the window should be selected. Next, to shorten the length of the blind to fit the length of the window, a slat 4*b* nearest the new length for the blind is identified. Each of the lift cords is then shortened to the selected slat. This is done by removing the snivee from its retainer 18 and positioning the snivee relative to the lift cord 46 so that the lift cord is aligned with the longitudinal axis of the snivee as shown in FIG. 6*b*. This is most easily done by first removing or repositioning the bottom 15 of the bottomrail 10. The snivee 20 is then threaded through the hole 12 in the top of the bottomrail and through the route holes 9 in the slats 4*c*, 4*d* and 4*e* which are to be removed. At that point the lift cord 46 and snivee 20 will be as shown in FIG. 6*c*. To prevent the snivee from being threaded through the selected slat 4*b* one could reduce the diameter of the route hole in the slat 4*b*. This can be done by placing a clip over a portion of the route hole or inserting a reducer into the route hole. That reducer could be a split washer made of a flexible material such as rubber or plastic. Another method would be to grasp the lift cord below the selected slat 4*b* and simply pull the lift cord through the slats to be removed. This means that each cord must be pulled individually. When the snivee 20 is below the selected slat 4*b* the snivee is turned relative to the lift cord so that the lift cord passes through the hole 24 in the snivee to orient the snivee relative to the lift cord as shown in FIG. 4. Consequently, slat 4*b* will rest on the snivee. At that point the lift cords are left to hang and slat 4*b* rests on the ladder rungs. Slats 4*c*, 4*d*, and 4*e* are removed after all of the lift cords 46 have been threaded to the new length so that the blind looks like that shown in FIG. 6*d*. The bottomrail is then detached from the ladders. The ladders are shortened and reattached to the bottomrail. Finally, each snivee is inserted through hole 12 into the bottomrail and secured in the cavity 13. Preferably, but not necessarily, a retainer 18 will be provided in the bottomrail 10 to receive and retain the snivee 20. Alternatively, the hole 12 will act as a retainer when the snivee is turned so as to be oriented transverse to the lift cord. The bottom 15 of the bottomrail 10 is replaced creating a shortened blind as shown in FIG. 6*e* and completing the procedure.

Figure 7:
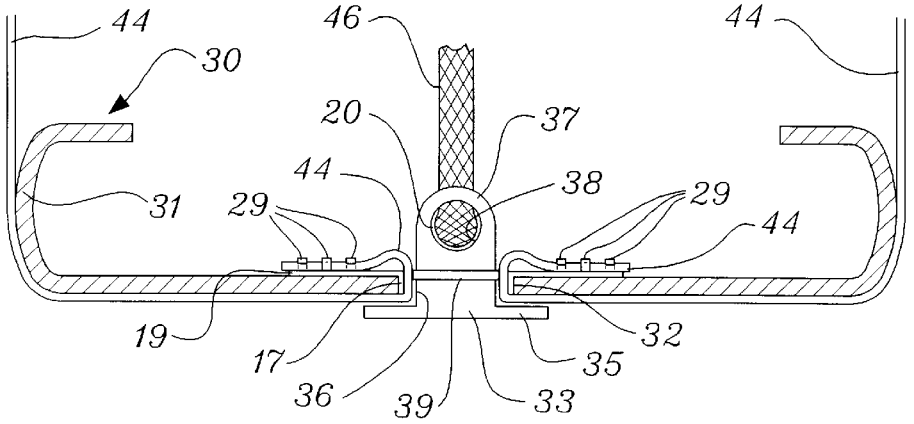
FIG. 7 is a cross sectional view similar to FIG. 5 of a second present preferred bottomrail.

A less expensive bottomrail is shown in FIG. 7. This bottomrail 30 has an elongated U-shaped body 31 with an open top. The retainer for the cord stop device is a plug 33 that fits through a hole 32 in the bottomrail. The plug 33 has a base 35, neck 36 that extends through the hole 32 and a head 37. A washer 19 having a collar 17 is fitted over the plug 33 so that the collar extends through the hole 32 in the bottomrail. The cord stop device such as snivee 20 is retained in a hole or cavity 38 in the head 37. The neck 36 is smaller in diameter than the hole 32 and has longitudinal channels to provide a passageway for the ladder rails. Tabs or barbs 39 may be provided to radially extend from the neck to engage the washer 19 and keep the plug in place. Alternatively, the neck could be threaded. If desired a series of pinch posts 29 can be extended from the washer 19 provided in the bottomrail. These posts are spaced at a distance smaller than the diameter of the ladder rungs so that a rung can be pinched between adjacent posts. The pinch posts and plug need not be used together, but can each be used separately. The plug and pinch posts permit the ladder to be easily detached from the bottomrail, shortened and then re-attached.

Figures 8, 9, 10, 11:
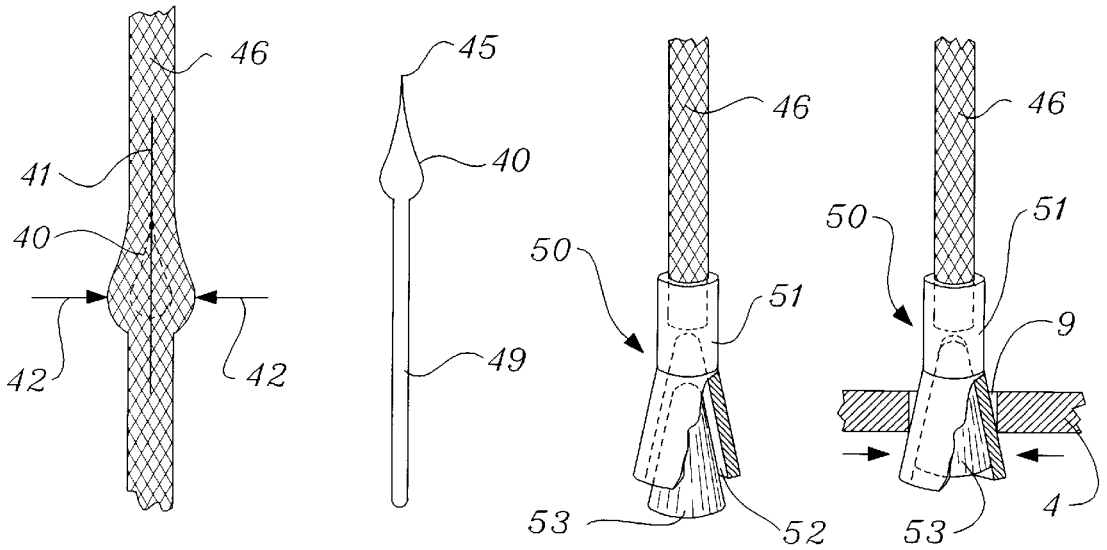
FIG. 8 is a side view of a second preferred cord stop device.
FIG. 9 is a side view of the stop device shown in FIG. 8 with a handle.
FIG. 10 is a side view of a third preferred cord stop device.
FIG. 11 is a side view of the cord stop device shown in FIG. 10 as it passes through a route hole in a slat.

A second present preferred cord stop device is an egg shaped insert 40 that is implanted into the lift cord 46 as shown in FIGS. 8 and 9. The insert 40 preferably is solid and made of acrylic or other plastic. If desired the insert material can be made of a compressible material such as rubber of vinyl. The insert 40 has a needle pointed end 45 and a handle 49. Using the handle 49 the insert 40 is implanted through a longitudinal slit 41 in the lift cord 46. The needle point 45 makes insertion easy. When the egg shaped body is within the cord, the handle 49 is broken off. The region of the cord near the insert is covered with a penetrating adhesive to keep the stop device in place. A colored adhesive can be used to mark the location. The insert is sized so that a teardrop shaped bulge is created in the cord. The widest diameter of the bulge indicated by arrows 42 is slightly smaller than the route holes 9 in the slats but larger than the diameter of the hole or cavity in the retainer. Thus the bulge will permit the cord to pass through the slats and be retained in the bottomrail. The retainer can be a slotted tube of decreasing inner diameter such that the cord is pulled through the tube and jams. The tail off cord behind the edge allows removal.

A two piece cord stop device 50 is shown in FIGS. 9 and 10. This device has a flexible frustro-conical body 51 which is crimped onto the end of the lift cord 46. A plug 53 is inserted into a frustro-conical cavity 52 in the bottom of the body 51. This causes the body to expand outwardly to its maximum diameter. The plug may be retained through a friction fit or have external threads that mate with internal threads in the cavity 52. The plug may be a separate piece or may be attached to the bottomrail. In this expanded condition the device will not fit through the hole or retainer in the bottomrail. Hence, the lift cord will be firmly attached to the bottomrail. When the plug 53 is removed from the cavity 52 in the body 51 the device can be radially compressed as indicated by the arrows in FIG. 11. When compressed the body 51 will fit through the route holes 9 in the slats 4.

The three cord stop devices disclosed here are all attached to a lift cord. They can all be manipulated to have a diameter or length along a direction perpendicular to the lift cord which is larger than or smaller than the route holes through the slats and the hole in the bottomrail or the cavity or hole in a retainer in the bottomrail. All are shaped to have a pointed or narrower upper end and wider lower end to enable the device to be self-orienting and to easily pass through the route holes.

Although I have shown and described certain present preferred embodiments of my length adjustable bottomrail and method for adjusting the length of a venetian type blind, it should be distinctly understood that the invention is not limited thereto but may be variously embodied within the scope of the following claims.

I claim:

1. A method of adjusting a length of a venetian type blind of the type having a headrail, a bottomrail, a plurality of slats between the headrail and the bottomrail, ladders attached to and extending between the bottomrail and the headrail and having opposite rails and rungs extending therebetween which carry the slats, and at least one lift cord passing from the headrail through a route hole in each slat to the bottomrail, a cord stop device attached to each lift cord and a retainer attached to the bottomrail to which each cord stop device is removably connected, each cord stop device having a selected shape such that the cord stop device can be removably connected to the retainer and when not connected to the retainer will orient itself to be self-guiding through route holes in selected slats when the lift cord is pulled through the selected slats, the method comprising:

a. selecting a blind having a length longer than a desired new length;

b. identifying a slat at the desired new length;

c. releasing each cord stop from the retainer to which the cord stop is connected;

d. passing each cord stop and attached lift cord through the route holes of the slats that are positioned below the slat identified in step b;

e. removing excess slats between the identified slat and the bottomrail to create a plurality of empty rungs;

f. detaching the ladders from the bottomrail;

g. shortening the ladders;

h. attaching the shortened ladders to the bottomrail; and i. returning the cords stops to their respective retainers in the bottomrail.

2. The method of claim 1 wherein the ladders are shortened by cutting portions of the ladders.

3. The method of claim 1 wherein the stop device is a snivee having a flat end, a pointed end, a transverse hole between the flat end and the pointed end and a slot extending from the transverse hole to the pointed end, the slot being narrower near the transverse hole.

4. A method of adjusting a length of a venetian type blind of the type having a headrail, a bottomrail, a plurality of slats between the headrail and the bottom rail, ladders attached to and extending between the bottomrail and the headrail and having opposite rails and rungs extending therebetween which carry the slats, and at least one lift cord passing from the headrail through a route hole in each slat to the bottomrail, a cord stop device attached to each lift cord and a retainer attached to the bottomrail to which each cord stop device is removably connected, each cord stop device having a selected shape such that the cord stop device can be removably connected to the retainer and when not connected to the retainer will orient itself to be self-guiding through route holes in selected slats when the lift cord is pulled through the selected slats, the method comprising:

a. selecting a blind having a length longer than a desired new length;

b. identifying a slat at the desired new length;

c. reducing the diameter of the route holes in the identified slat so that each cord stop is unable to pass through the route holes of reduced diameter;

d. releasing each cord stop from the retainer to which the cord stop is connected;

e. passing each cord stop and attached lift cord through the route holes of the slats that are positioned below the slat identified in step b;

f. removing excess slats between the identified slat and the bottomrail to create a plurality of empty rungs;

g. detaching the ladders from the bottomrail;

h. shortening the ladders;

i. attaching the shortened ladders to the bottomrail; and j. returning the cords stops to their respective retainers in the bottomrail.

* * * * *